US008181615B2

(12) United States Patent
Maeno

(10) Patent No.: US 8,181,615 B2
(45) Date of Patent: May 22, 2012

(54) LASH ADJUSTER FOR SWING ARM TYPE VALVE GEAR

(75) Inventor: Eiji Maeno, Iwata (JP)

(73) Assignee: NTN Corporation, Osaka (JP)

( * ) Notice: Subject to any disclaimer, the term of this patent is extended or adjusted under 35 U.S.C. 154(b) by 447 days.

(21) Appl. No.: 12/597,007

(22) PCT Filed: May 13, 2008

(86) PCT No.: PCT/JP2008/058765

§ 371 (c)(1),
(2), (4) Date: Oct. 22, 2009

(87) PCT Pub. No.: WO2008/140079

PCT Pub. Date: Nov. 20, 2008

(65) Prior Publication Data

US 2010/0126453 A1 May 27, 2010

(30) Foreign Application Priority Data

May 14, 2007 (JP) ..... 2007-128035

(51) Int. Cl.
*F01L 1/18* (2006.01)

(52) U.S. Cl. ..... 123/90.45; 123/90.52

(58) Field of Classification Search ..... 123/90.45, 123/90.46, 90.52–90.59
See application file for complete search history.

(56) References Cited

U.S. PATENT DOCUMENTS

| | | | |
|---|---|---|---|
| 6,109,228 | A | 8/2000 | Yamamoto et al. |
| 6,901,896 | B2 | 6/2005 | Yamamoto et al. |
| 2003/0075131 | A1 * | 4/2003 | Gill ..... 123/90.45 |

FOREIGN PATENT DOCUMENTS

| | | |
|---|---|---|
| JP | 3-8603 | 1/1991 |
| JP | 11-062519 | 3/1999 |
| JP | 2000-110523 | 4/2000 |
| JP | 2003-521624 | 7/2003 |
| JP | 2004-346821 | 12/2004 |
| JP | 2007-092668 | 4/2007 |

OTHER PUBLICATIONS

International Search Report issued Jun. 10, 2008 in International (PCT) Application No. PCT/JP2008/058765.

* cited by examiner

*Primary Examiner* — Thomas Denion
*Assistant Examiner* — Daniel Bernstein
(74) *Attorney, Agent, or Firm* — Wenderoth, Lind & Ponack, L.L.P.

(57) ABSTRACT

The object is to provide a lash adjuster that can be easily and repeatedly mounted on a swing arm type valve gear, having an adjusting screw that can be repeatedly held in a pushed-in state with a general-purpose turning tool such as a wrench. A serrated internal thread 24 is formed on the inner circumferential face of a cylindrical body 21 having closed bottom end, and a serrated external thread 26 formed on the outer circumferential face of an adjusting screw 25 engages with the internal thread 24. A return spring 27 is mounted in the body to bias the adjusting screw 27 in the protruding direction. A friction member 31 is provided between the bottom faces of the adjusting screw 25 and the body 21. A spherical pivot portion 32 is formed on the top of the adjusting screw 25, and an engaging hole 33 is formed in the top end of the pivot portion 32. The adjusting screw is rotated in the fastening direction by rotating operation of a turning tool T engaging with the engaging hole 33, and the bottom face of the adjusting screw 25 is pressed against the friction member 31, thereby holding the adjusting screw 25 in pushed-in state and making mounting of the lash adjuster to a swing arm type valve gear easy.

6 Claims, 4 Drawing Sheets

LASH ADJUSTER FOR SWING ARM TYPE VALVE GEAR

TECHNICAL FIELD

This invention relates to a lash adjuster for automatically adjusting valve clearance of a valve gear of an internal combustion engine.

BACKGROUND ART

Generally in valve gears that open and close an intake valve or an exhaust valve (simply 'valve', hereafter) with rotation of a cam, there are direct type, which pushes down a valve stem directly by rotation of a cam to open a valve, and arm type, which pivots an arm by rotation of a cam so that the arm pushes down a valve stem to open a valve.

Further, in the arm type, swing arm type, in which an arm is provided below a cam and one end of the arm is supported with a pivot, and rocker arm type, in which an arm is pivotably supported around a rocker shaft provided above a cam.

In any of the above-mentioned valve gears, valve clearance is automatically adjusted by mounting a lash adjuster.

For the above-mentioned lash adjuster, a mechanical lash adjuster is known having a cylindrical body formed with a serrated internal thread on the inner circumferential face and an adjusting screw formed with an external thread on the outer circumferential face, the internal and external threads being in thread engagement with each other. The adjusting screw is biased in the protruding direction with a return spring.

In the above-mentioned mechanical lash adjuster, if the lash adjuster is mounted in a valve gear in an extended state, compression leak and incomplete explosion may occur during cranking of the engine, and also the intake valve and the exhaust valve may interfere with each other and be damaged. The lash adjuster therefore has to be mounted in a valve gear in a pushed-in state.

If the lash adjuster is configured to be retained in compressed state by a finger during mounting, the mounting process becomes very laborious. To solve such inconvenience, in the lash adjuster described in Patent Document 1, a pin hole is formed in the closed end of the body and a pin inserted in this pin hole is inserted in a radial pin hole formed in the adjusting screw so as to keep the adjusting screw in the pushed-in position.

Also, in the lash adjuster described in Patent Document 2, the adjusting screw is kept in a pushed-in state using a wax with a low melting point so that the wax is melted as the temperature in the internal combustion engine rises, thereby releasing the retention of the adjusting screw.

Further, in the lash adjuster used for a rocker arm type valve gear described in Patent Document 3, a U-shaped retainer is fit on the end of the rocker arm on the side to which the lash adjuster is mounted, thereby retaining the adjusting screw in pushed-in position.

Patent Document 1: JP 11-62159A
Patent Document 2: JP 2000-110523A
Patent Document 3: JP 2007-92668A

DISCLOSURE OF THE INVENTION

Object of the Invention

In an initial setting method in which the adjusting screw is retained in pushed-in state by inserting a pin, such as disclosed in Patent Document 1, pin holes have to be formed both in the body and in the adjusting screw, which makes the manufacturing process laborious. Also setting of the pin is laborious since the pin holes in the body and in the adjusting screw have to be aligned. Further, this method cannot be applied to a pivot type lash adjuster, which is used for a swing arm type valve gear, since such a lash adjuster is mounted in a fitting hole formed in the cylinder head.

Also, while an initial setting method in which the adjusting screw is retained in pushed-in state with wax, such as disclosed in Patent Document 2, can be applied for lash adjusters of both direct type valve gear and arm type valve gear, once the wax is melted, the adjusting screw cannot be re-set in pushed-in state, and therefore re-mounting of the lash adjuster in processes such as engine overhaul becomes laborious.

Further, an initial setting method in which the adjusting screw is retained in pushed-in state by fitting a U-shaped retainer, such as disclosed in Patent Document 3, cannot be applied for a pivot type lash adjuster used in a swing arm type valve gear.

The object of this invention is to provide a lash adjuster that can be easily mounted on a swing arm type valve gear, having an adjusting screw that can be repeatedly held in a pushed-in state with a general purpose turning tool such as a wrench.

Means to Achieve the Object

To achieve the above-mentioned object, this invention provides a lash adjuster comprising a cylindrical body having a closed bottom end and fitted in a fitting hole formed in a cylinder head, an adjusting screw mounted in the body and formed with a spherical pivot portion on its top end protruding from the top end of the body, the pivot portion pivotably supporting one end of a swing arm, and a return spring mounted in the body and biasing the adjusting screw in the protruding direction from the body, wherein the body is formed with an internal thread on its inner circumferential face, wherein an external thread meshing with the internal thread is formed on the outer circumferential face of the adjusting screw, and wherein the external and internal threads have a serration-shaped section so that the flank angle of the pressure flank thereof, which receives axial pushing load applied on the adjusting screw, is larger than the flank angle of the clearance flank thereof, characterized in that, between the bottom faces of the body and the adjusting screw, a perforated disc-shaped friction member is provided to contact the bottom face of the adjusting screw and to prevent the adjusting screw from rotating and moving in the protruding direction by the pressing force of the return spring, and that an engagement hole is formed in the top portion of the adjusting screw that protrudes from the body so that a turning tool can be engaged in.

By using a material comprising synthetic resin or a rubber for the friction member, manufacturing cost can be reduced since these materials can be formed in methods such as injection molding.

In a lash adjuster with the configuration described above, a turning tool is engaged in the engaging hole, and the adjusting screw is rotated in the fastening direction by rotating the turning tool to press the bottom face of the adjusting screw against the friction member. Rotation of the adjusting screw is stopped by frictional resistance working on the contact face between the friction member and the adjusting screw, thereby retaining the adjusting screw in pushed-in state.

The lash adjuster is mounted in the fitting hole formed in the cylinder head in the initial setting state in which the adjusting screw is retained in pushed-in state. After mounting, a turning tool is engaged in the engaging hole, and the adjusting screw is rotated in the loosening direction by rotating the turning tool to release the retention of the adjusting screw. Pushed by the return spring, the adjusting screw rotates and moves in the protruding direction, thereby completing the mounting of the lash adjuster.

At this time, if the body is rotated together with the adjusting screw when the adjusting screw is rotated in the loosening direction, retention of the adjusting screw cannot be released. To prevent the body from rotating together with the adjusting screw, it is effective to increase frictional resistance between the bottom faces of the body and the fitting hole by forming grooves on at least one of the bottom surfaces of body and the fitting hole, or by forming a rough surface at least on one of the bottom faces of said body and said fitting hole.

Effect of the Invention

As described above, by rotating the adjusting screw in the fastening direction and pressing its bottom face to the friction member, the adjusting screw can be retained in pushed-in state, thereby making it easy to mount the lash adjuster on the swing arm type valve gear.

Also, since the adjusting screw is retained by making its bottom face pressed against the friction member, the adjusting screw can be repeatedly retained in pushed-in state, and the lash adjuster can be re-mounted easily.

Further, by forming the engaging hole for a turning tool on the top of the adjusting screw, retention and release of the adjusting screw can be done with a general-purpose tool such as a wrench.

DESCRIPTION OF THE NUMERALS

Figure 1:
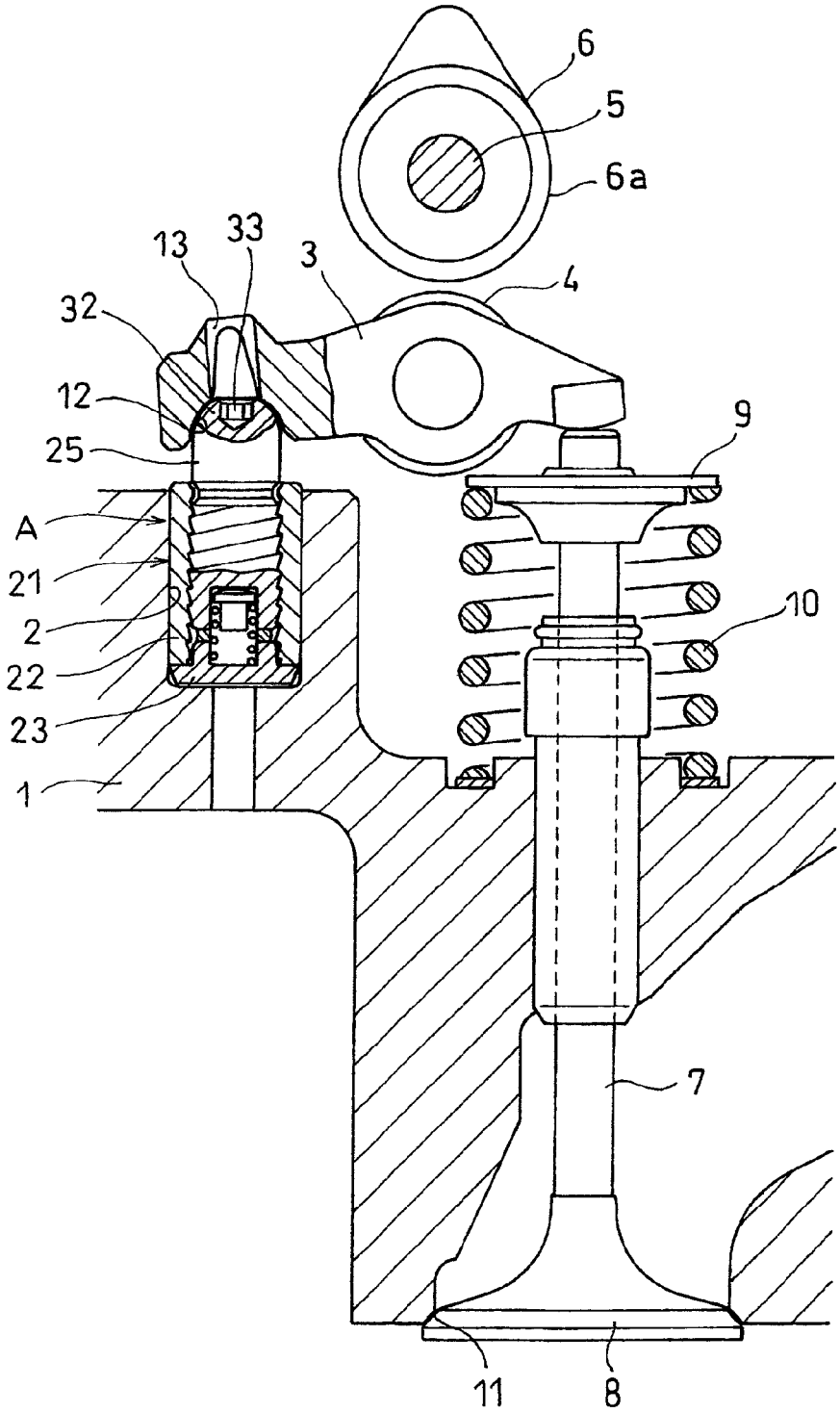
FIG. 1 is a vertical sectional view of a swing arm type valve gear mounted with a lash adjuster according to this invention.

1 Cylinder head
2 Fitting hole
3 Swing arm
21 Body
24 Internal thread
25 Adjusting screw
26 External thread
27 Return spring
29 Pressure flank
30 Clearance flank
31 Friction member
32 Pivot portion
33 Engaging hole
34 Groove

Best Mode for Embodying the Invention

The following is a description of the embodiment of the present invention with reference to the attached drawings. FIG. 1 shows a lash adjuster A according to the present invention mounted on a swing arm type valve gear. In this swing arm type valve gear, the lash adjuster A is mounted in a fitting hole 2 formed in a cylinder head 1, supporting one end of a pivotable swing arm 3. In the middle of the swing arm 3, a roller 4 is rotatably supported. By rotation of a cam 6 mounted on a cam shaft 5, the roller 4 is pressed down so that the swing arm 3 pivots. Thus the other end of the swing arm 3 presses down a valve stem 7 so as to open a valve 8 provided at the bottom of the valve stem 7.

The valve stem 7 has a spring retainer 9 on its top end. Pushing force of a valve spring 10 is applied to the spring retainer 9 so as to bias the valve stem 7 in the direction that the valve 8 at the bottom is pressed against a valve seat 11.

At the one end of the swing arm 3, a spherical seat 12 is formed on the bottom face, and a tool insertion hole 13 extends from the top face through the spherical seat 12.

Figure 2:
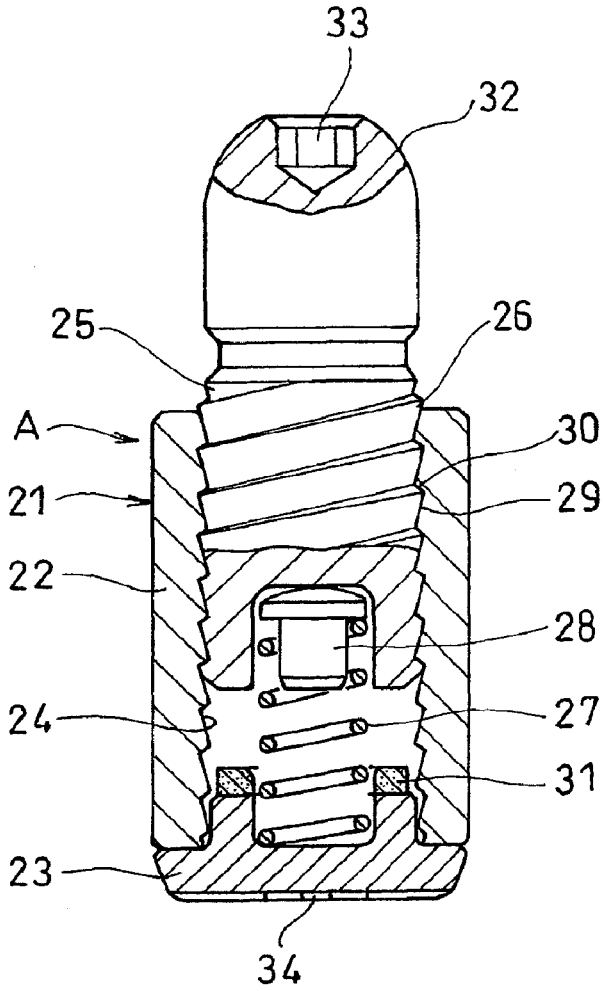
FIG. 2 is a vertical sectional view of the lash adjuster of FIG. 1.
Figure 3:
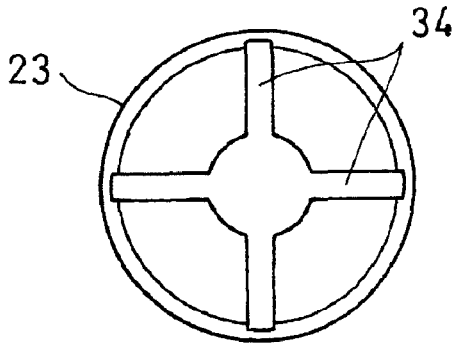
FIG. 3 is a bottom view of the lash adjuster.

As shown in FIGS. 2 and 3, the lash adjuster A has a cylindrical body 21 fit in the fitting hole 2. The body 21 comprises a cylindrical member 22 and a cap 23 pressed in the bottom of the cylindrical member 22. On the inner circumferential face of the cylindrical member 22, an internal thread 24 is formed and in thread engagement with an external thread 26 formed on the outer circumferential face of an adjusting screw 25.

A return spring 27 and a spring seat 28 are mounted in the body 21. The adjusting screw 25 is biased in the direction to protrude from the open top end of the body 21 by the return spring 27.

The internal thread 24 formed on the inner circumferential face of the cylindrical member 22 and the external thread 26 formed on the outer circumferential face of the adjusting screw 25 have a serration shaped section so that the angle of the pressure flank 29 is larger than the angle of the clearance flank 30. These serration threads have such a lead angle that the adjusting screw 25 moves in the axial direction while rotating by pressing force of the return spring 27.

In the body 21, a perforated disc-shaped friction member 31 is provided between the cap 23 and the adjusting screw 25. The friction member 31 is made of a material with a high friction coefficient such as a synthetic resin or a rubber. The bottom face of the adjusting screw 25 is pressed against the friction member 31 and the adjusting screw 25 is kept in a pushed-in position by frictional resistance acting on the contacting area.

Figure 4:
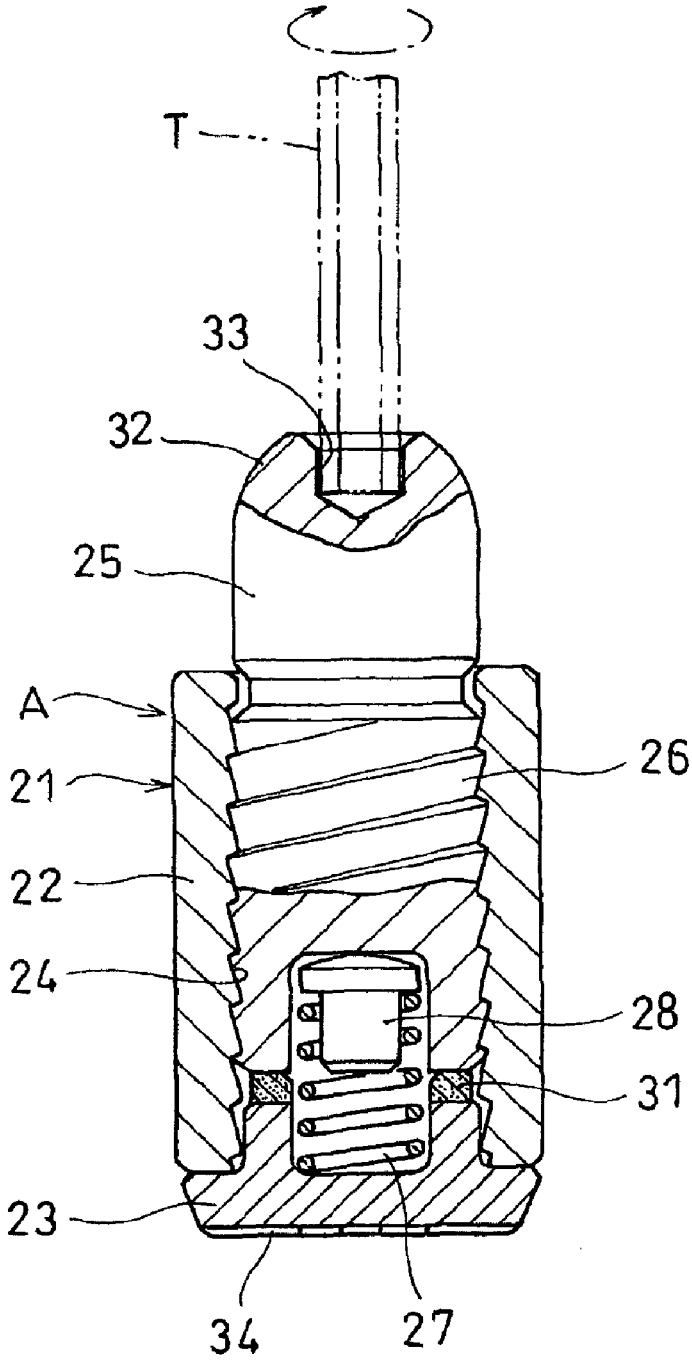
FIG. 4 is a sectional view of the lash adjuster, showing how the adjusting screw is retained in pushed-in state.

On the top end of the adjusting screw 25, which protrudes from the top end of the body 21, a spherical pivot portion 32 is formed, supporting the spherical seat 12 formed on the one end of the swing arm 3. On the top end of the pivot portion 32, an engagement hole 33 is formed so that, as shown in FIG. 4, a general-purpose turning tool T can be engaged in.

Now description is made of how the lash adjuster A is mounted on the swing arm type valve gear of the embodiment. As shown in FIG. 4, the turning tool T is engaged in the engagement hole 33, and the adjusting screw 25 is rotated in the fastening direction by the rotation of the turning tool T so that the bottom of the adjusting screw 25 is pressed against the friction member 31.

When the adjusting screw 25 is pressed against the friction member 31, frictional resistance acts on the contacting area, keeping the adjusting screw 25 in the pushed-in position, thereby keeping the lash adjuster A in compressed, initial setting state. In this state, the lash adjuster A is fit in the fitting hole 2 of the cylinder head 1 shown in FIG. 1 to complete mounting.

Figure 5:
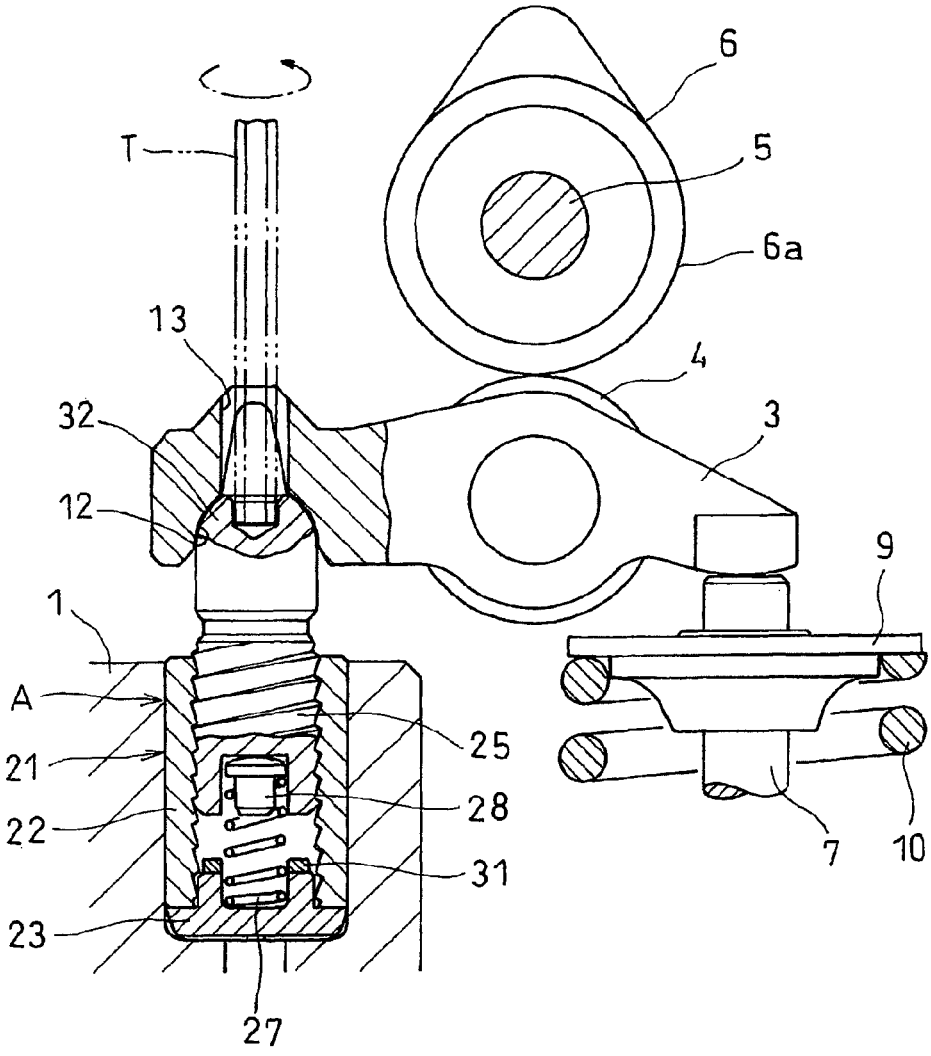
FIG. 5 is a sectional view of the lash adjuster, showing the state where the adjusting screw has been released from the pushed-in state.

After mounting the lash adjuster A, the swing arm 3 and the cam shaft 5 are mounted so that the spherical seat 12 of the swing arm 3 is supported by the pivot portion 32 of the adjusting screw 25. After mounting the cam shaft 5, as shown in FIG. 5, the turning tool T is inserted in the tool insertion hole 13 and engaged in the engagement hole 33. When the adjusting screw 25 is rotated in the loosening direction by the turning tool T, the adjusting screw 25 moves away from the friction member 31, and thereby the adjusting screw 25 is released.

At this time, by pressing force of the return spring 27, the adjusting screw 25 moves in the protruding direction while rotating, pushing up the one end of the swing arm 3. This makes the roller 4 pressed against the outer circumference of the cam 6 as shown in FIG. 5, thereby making the swing arm type valve gear come into operating state.

When the adjusting screw 25 is rotated in the loosening direction, the adjusting screw 25 cannot be released if the body 21 rotates together. To prevent this, as shown in FIG. 3, grooves 34 are formed on the bottom face of the cap 23 to increase friction against the bottom of the fitting hole 2.

Instead, such grooves may be formed on the bottom face of the fitting hole 2. Or instead of such grooves 34, a rough surface may be formed on at least one of the bottom faces of the body 21 and the fitting hole 2 to increase frictional resistance between the bottom faces of the body 21 and the fitting hole 2.

As described above, the adjusting screw 25 is rotated in the fastening direction and its bottom face is pressed against the friction member 31, thereby keeping the adjusting screw 25 in the pressed-in condition. This makes the lash adjuster A easy to mount on the swing arm type valve gear.

Also, since the adjusting screw 25 is kept in the pushed-in state by pressing its bottom face against the friction member 31, the adjusting screw 25 can be retained in the pressed-in state repeatedly. This makes re-mounting of the lash adjuster A easy.

Further, since the engagement hole 33 for a turning tool T is formed on the top of the adjusting screw 25, the adjusting screw 25 can be retained and released with a general-purpose tool such as a wrench.

In such an operating state of the swing arm type valve gear as shown in FIG. 5, if a valve clearance occurs between the valve stem 7 and the adjusting screw 25 by thermal expansion of the cylinder head 1, the adjusting screw rotates along the clearance flank 30 and moves in the protruding direction by pressing force of the return spring 27, thereby absorbing the valve clearance.

Also, when the adjusting screw 25 receives pushing force by the valve stem 7, it moves in the axial direction until the axial gap formed in the engaging portion between the internal thread 24 and the external thread 26 of the adjusting screw 25 disappears. If further pushing force is applied, the pressure flanks 29 pressed against each other receive the above-mentioned pushing force, thereby preventing the adjusting screw 25 from rotating and moving in the direction to sink in the body 21.

Oppositely, if the distance between the top end of the valve stem 7 and the cam 6 is shortened due e.g. to wear of the valve seat 11, the adjusting screw 25 receives the axial fluctuating load from the valve stem 7 and gradually rotates and moves in the direction to sink in the body 21, thereby preventing the valve 8 from closing incompletely when the base circle 6*a* of the cam 6 contacts the roller 4. At this time, the adjusting screw 25 is pushed in from the position in which the minimum axial fluctuating load is null by just the amount of the screw gap, and does not retract any more.

On the other hand, during a steady operation that does not need adjustment of a valve clearance, the adjusting screw 25 rotates little and repeats axial displacement within a range of an axial screw gap formed between the thread engagement portions of the internal thread 24 and the external thread 26 of the adjusting screw 25.

What is claimed is:

1. A lash adjuster for a swing arm type valve gear comprising a cylindrical body having a closed bottom end and fitted in a fitting hole formed in a cylinder head, an adjusting screw mounted in said body, said adjusting screw being formed, at a top end thereof, with a spherical pivot portion protruding in a protruding direction from a top end of said body, said pivot portion pivotably supporting one end of a swing arm, and a return spring mounted in said body and biasing said adjusting screw in the protruding direction from said body, wherein said body is formed with an internal thread on an inner circumferential face thereof, wherein an external thread meshing with said internal thread is formed on an outer circumferential face of said adjusting screw, and wherein said external and internal threads have a serration-shaped section so that a flank angle of a pressure flank thereof, which receives axial pushing load applied on the adjusting screw, is larger than a flank angle of a clearance flank thereof, wherein, between the bottom faces of said body and said adjusting screw, a perforated disc-shaped friction member is provided to contact the bottom face of the adjusting screw and to prevent the adjusting screw from rotating and moving in the protruding direction by a pressing force of said return spring, and wherein an engagement hole is formed in a top portion of said adjusting screw that protrudes from said body so that a turning tool can be engaged in the engagement hole.

2. The lash adjuster for a swing arm type valve gear of claim 1 wherein said friction member is made of a synthetic resin or a rubber.

3. The lash adjuster for a swing arm type valve gear of claim 1 wherein grooves are formed on at least one of the bottom face of said body and a bottom face of said fitting hole.

4. The lash adjuster for a swing arm type valve gear of claim 1 wherein at least one of the bottom face of said body and a bottom face of said fitting hole is a rough surface.

5. The lash adjuster for a swing arm type valve gear of claim 2 wherein grooves are formed on at least one of the bottom face of said body and a bottom face of said fitting hole.

6. The lash adjuster for a swing arm type valve gear of claims 2 wherein at least one of the bottom face of said body and a bottom face of said fitting hole is a rough surface.

* * * * *